US005157795A

United States Patent [19]

Pasquin

[11] Patent Number: 5,157,795

[45] Date of Patent: Oct. 27, 1992

[54] DUAL FLUSH VALVE FOR WATER CLOSETS

[76] Inventor: John P. Pasquin, 3254 S. Barney, West Valley City, Utah 84119

[21] Appl. No.: 580,849

[22] Filed: Sep. 11, 1990

Related U.S. Application Data

[63] Continuation-in-part of Ser. No. 418,858, Oct. 10, 1989, Pat. No. 5,005,225, which is a continuation-in-part of Ser. No. 326,366, Mar. 21, 1989.

[51] Int. Cl.[5] ..... E03D 1/14

[52] U.S. Cl. ..... 4/324

[58] Field of Search ..... 4/324, 325, 381, 382, 4/384, 415

[56] References Cited

U.S. PATENT DOCUMENTS

| | | | |
|---|---|---|---|
| 3,421,161 | 1/1969 | Stafford et al. | 4/325 |
| 4,025,968 | 5/1977 | Davis | 4/325 |
| 4,080,669 | 3/1978 | Biggerstaff | 4/325 |
| 4,175,296 | 11/1979 | Goldman | 4/325 |
| 4,809,367 | 3/1989 | Scott | 4/324 |
| 4,969,218 | 11/1990 | Comparetti | 4/324 X |

*Primary Examiner*—Charles E. Phillips
*Attorney, Agent, or Firm*—Trask, Britt & Rossa

[57] ABSTRACT

A dual flush valve assembly for use in the water storage reservoir of a conventional toilet is disclosed. The assembly includes a valve, a guide track, a pair of slider members, slideably mounted in the guide track and individually connected to the valve and an actuation assembly adapted for controlling the displacement of those slider members. The valve is adapted for effecting a discharge of a first quantity of water, and a second quantity of water. The action of the valve is controlled by the actuation assembly effecting a displacement of one or more of the slider members. The first quantity of water is measureably smaller than the second quantity of water. The invention provides a means whereby the user may select the quantity of water discharged in a flush cycle according to the type of waste materials being disposed of.

10 Claims, 11 Drawing Sheets

DUAL FLUSH VALVE FOR WATER CLOSETS

This is a continuation-in-part application of Ser. No. 418,858 filed Oct. 10, 1989 entitled "DUAL FLUSH VALVE FOR WATER CLOSETS, " U.S. Pat. No. 5,005,225 which is a continuation-in-part of application Ser. No. 326,366 filed 21 Mar. 1989 and entitled "DUAL FLUSH VALVE FOR WATER CLOSETS."

BACKGROUND OF THE INVENTION

1. Field

This invention relates to valves adapted for channeling fluids. More specifically, this invention is directed to a flush valve assembly for use in conventional toilets.

2. Statement of the Art

Water is a critical necessity for the continuation of human life. As an increasing population places more demands on the already scarce supplies of water, efforts both in the private sector and in government agencies have been directed toward the more efficient use of this resource. One of the most quantity-demanding uses of present water supplies is that of waste disposal, specifically human waste disposal.

In the past few years, many approaches have been advanced for limiting the quantity of water required for effectively and safely disposing of human waste. In this vein, the art discloses several attempts directed to reducing the quantity of water utilized in the operation of conventional toilets. Simple attempts include the placement of bricks, wasted plastic bottles or other articles into the toilet's water storage reservoir. These efforts have principally focused on reducing the storage capacity of the reservoir and thereby limiting the quantity of water that is discharged per flush cycle. Other attempts have involved bending the arm which supports the float. The arm controls the water intake valve responsible for refilling the reservoir to an operating level. Alternative approaches have involved the use of baffles, placed either about the reservoir sidewalls or within the reservoir outlet, adapted for retaining water within the reservoir during flushing.

The aforesaid approaches have all been directed to reducing, by a constant amount, the quantity of water discharged from the toilet's reservoir per flush cycle. While on its face, this objective appears desirable, problems have arisen for the user of such approaches. In the past, toilets and the sewer pipelines associated therewith were designed using the flush capacity of the toilet's storage reservoir as a governing criteria. With the reduction in the quantity of water discharged during a flushing cycle, resulting from adoption of the above-described approaches, oftentimes the decreased quantity of water discharged in a normal flush cycle is insufficient to dispose adequately the waste materials in the toilet bowl through the residential sewer lines, and into the municipal sewer system. With repeated operation of the toilet, soon the residence's sewer lines became clogged, necessitating costly and unpleasant cleaning operations.

Resultingly, while the aforesaid approaches do achieve the objective of reducing the quantity of water consumed by toilet operation, on the other hand, these approaches oftentimes have proved themselves less than advantageous in that they created other problems, whose resolution is more expensive than the cost savings achieved through the conservation of water.

There continues to be a need for structures which can at once address the problem of conserving water in toilet operation, while simultaneously and adequately relaying the waste materials from the toilet bowl, through the residence's sewer lines to the community sewer system.

SUMMARY OF THE INVENTION

A flush valve adapted for use in the water storage reservoir of a conventional toilet is disclosed. The flush valve is directed for opening and closing the water discharge outlet of the reservoir.

The invention may be considered as an attachment which is mountable to a standard toilet valve to convert the conventional single volume flush valve to allow a small volume flush or a large volume flush according to the selection of an activating handle. Alternatively, the invention may be viewed as complete valve assembly.

In terms of structure, the flush valve includes a valve means, adapted for closing and opening the water outlet; a vertically-disposed guide track; a pair of sliding members which are slidably and displaceably mounted on said guide track, the sliding members are connected to the valve means; a pair of buoyant floats, each float being mounted on a respective sliding member and an actuation means adapted for selectively displacing the sliding members.

The flush valve is constructed to facilitate a first flush condition wherein the actuation means effects a displacement of one of the sliding members which results in the valve means opening and discharging a first quantity of water from the storage reservoir. The flush valve is further structured to facilitate a second flush condition wherein the actuation means effects a displacement the other sliding member which results in the valve means opening and discharging a second quantity of water from the storage reservoir. The volume of water in the first quantity of water is measureably different from the volume of water in the second quantity of water.

DETAILED DESCRIPTION OF THE DRAWINGS

Figure 1:
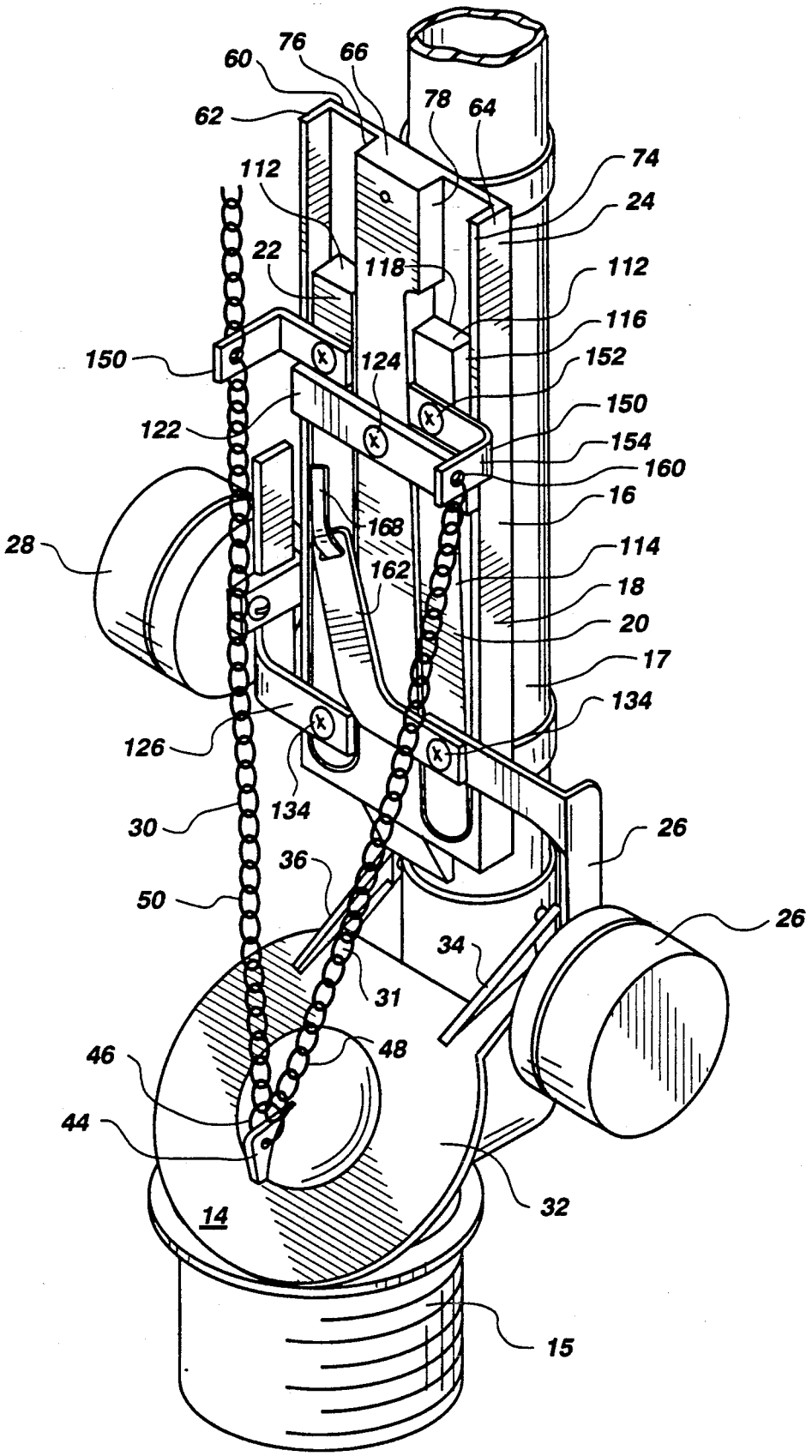
FIG. 1 is a perspective view of a flush valve of the invention shown with the flapper valve in a closed condition.

As shown to advantage in FIG. 1, a flush valve of the invention generally includes a flapper valve generally 14 which is mounted to an upright support 16. This support is adapted for mounting within the water discharge outlet of the storage reservoir of a conventional toilet. Also mounted on the support 16 is a pair of slideably displaceable members 20 and 22 which are slideably mounted in a vertically oriented guide track 24. Each of the sliding members 20 and 22 is fitted with a respective buoyant member 26, 28. The flapper valve 14 is connected to each of the sliding members 20 and 22 by means of a flexible linkage member 30, 31.

THE FLAPPER VALVE

As shown in FIGS. 1 through 5, flapper valve 14 is generally of a conventional construction. The valve includes a generally planar circular member 32 having mounted thereon two laterally-extending members 34 and 36.

Figure 2:
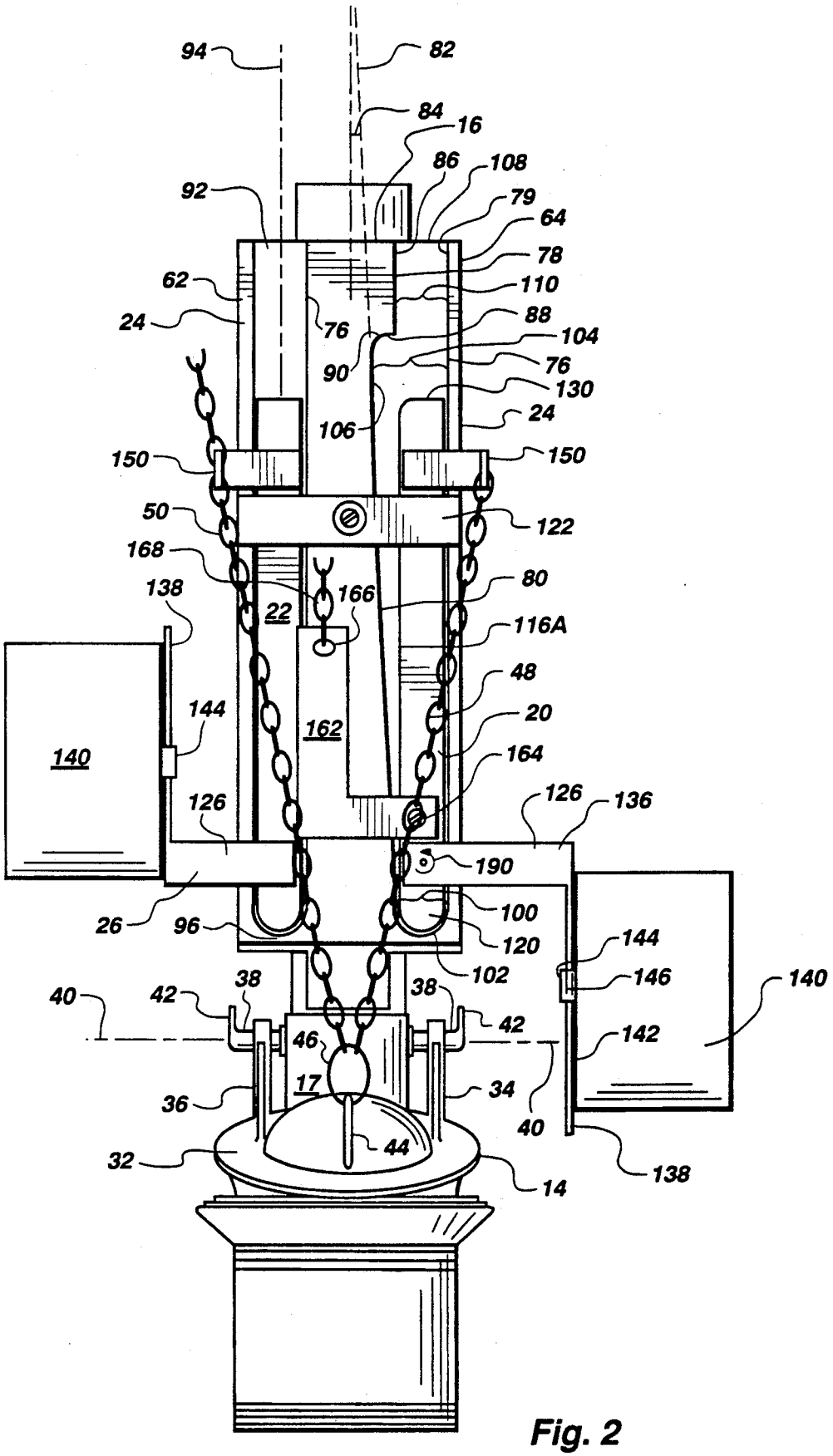
FIG. 2 is a front view of the flush valve shown in FIG. 1.

As shown to in FIG. 2, the laterally-extending members 34 and 36 extend generally parallel one another spacedly apart from each other. Each of the members 34 and 36 is received on a respective shaft-like lateral extending axle member 38 which is mounted on overflow pipe 17. Each extending member 34 and 36 defines an aperture therein which is configured to slideably receive its respective axle 38. The mounting of the members 34 and 36 on their respective axles 38 provides a rotatable connection whereby each of the extensions 34 and 36 may rotate about its respective axle 38 about the rotational axis 40 as shown in FIG. 2. An ear 42 is mounted on the end of each respective axle 38 to provide a means of retaining the member 34 and member 36 on their respective axles during the operation of the valve.

As shown to advantage in FIG. 2, the rotational axis 40 is oriented generally horizontal and thereby provides a means whereby the flush valve 14 may rotate in a vertical plane generally about a horizontal axis. The flush valve 14 includes a mounting bracket 44 which is positioned atop the generally planar circular member 32. The bracket 44 is fitted with a generally circular ring 46 which is adapted to interconnect with a plurality of chains 48 and 50 which are in turn interconnected with the sliding members 20 and 22.

Figure 5:
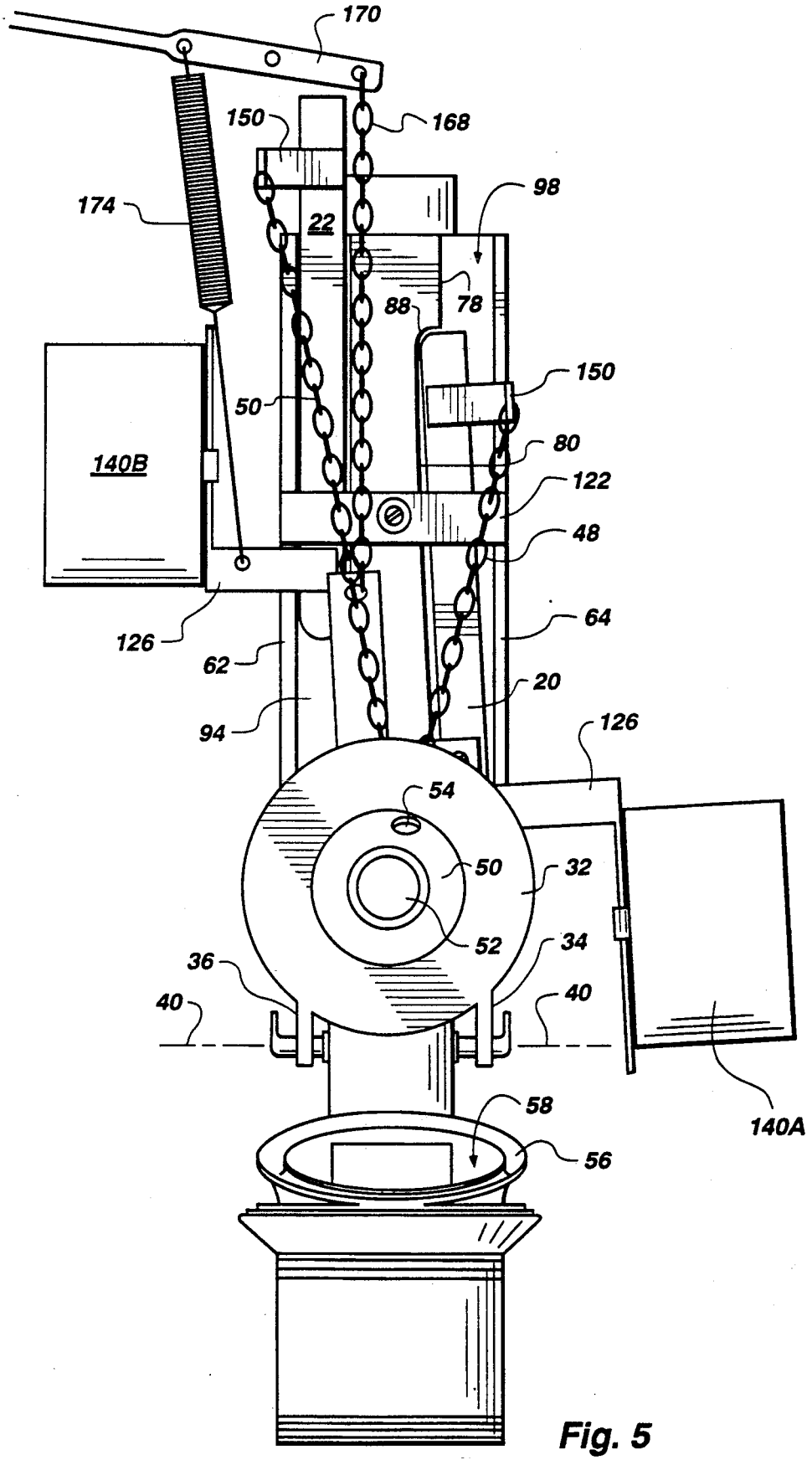
FIG. 5 is a front view of the flush valve when the valve is in a first-open condition.

As shown to advantage in FIG. 5, the lower surface of the circular member 32 of the valve 14 defines a generally conical member 50 which extends outwardly generally perpendicularly from the planar surface of circular member 32. The conical member 50 is hollow and defines a generally circular aperture 52 on its open end which communicates the environment with the hollow interior of the member 50.

As further shown in FIG. 5, the conical member 50 also defines a second aperture 54 which is defined within the sidewall of the member 50. The aperture 54 is positioned generally proximate to the uppermost edge of the member 50 and is furthermore proximate the point of connection of the member 50 and the circular member 32. In conventional flapper construction, the member 50 generally defines only one aperture which corresponds generally to aperture 52 as shown in FIG. 5. In the instant invention, it has been found that a aperture corresponding to aperture 54 optimizes the operation of the valve.

In operation, when the flapper valve 14 is disengaged from its seat 56, the hollow interior of the member 50, being filled with air, creates a upwardly-directed force on the flapper valve due to buoyancy. The action of the buoyant-induced forces causes the circular member 32 to be forcefully directed upward out of engagement with the seat 56 thereby providing an opportunity for the water within the storage reservoir of the toilet to be discharged out of the reservoir through the outlet 58 without the circular member 32 being urged sufficiently downward to reengage with the seat 56 and thereby close outlet 58. With the aperture 54 being configured within the member 50, the air contained within the interior of member 50 is more easily discharged from the interior of the member 50 and thereby provides a more rapid response time for the reengagement of the flapper valve 14 with the seat 56.

The circular member 32 is generally fabricated from an elastomeric material such as rubber. It has been found that a flapper valve generally corresponding to that described in U.S. Pat. No. 4,698,859 is functional in the instant invention provided that valve is modified by the construction of an aperture 54 within the member 50. The specification of the aforesaid patent is hereby incorporated by reference, as defining a flapper valve of sufficient dimensional characteristics to be utilized in construction of the instant invention.

THE GUIDE TRACK

Figure 3:
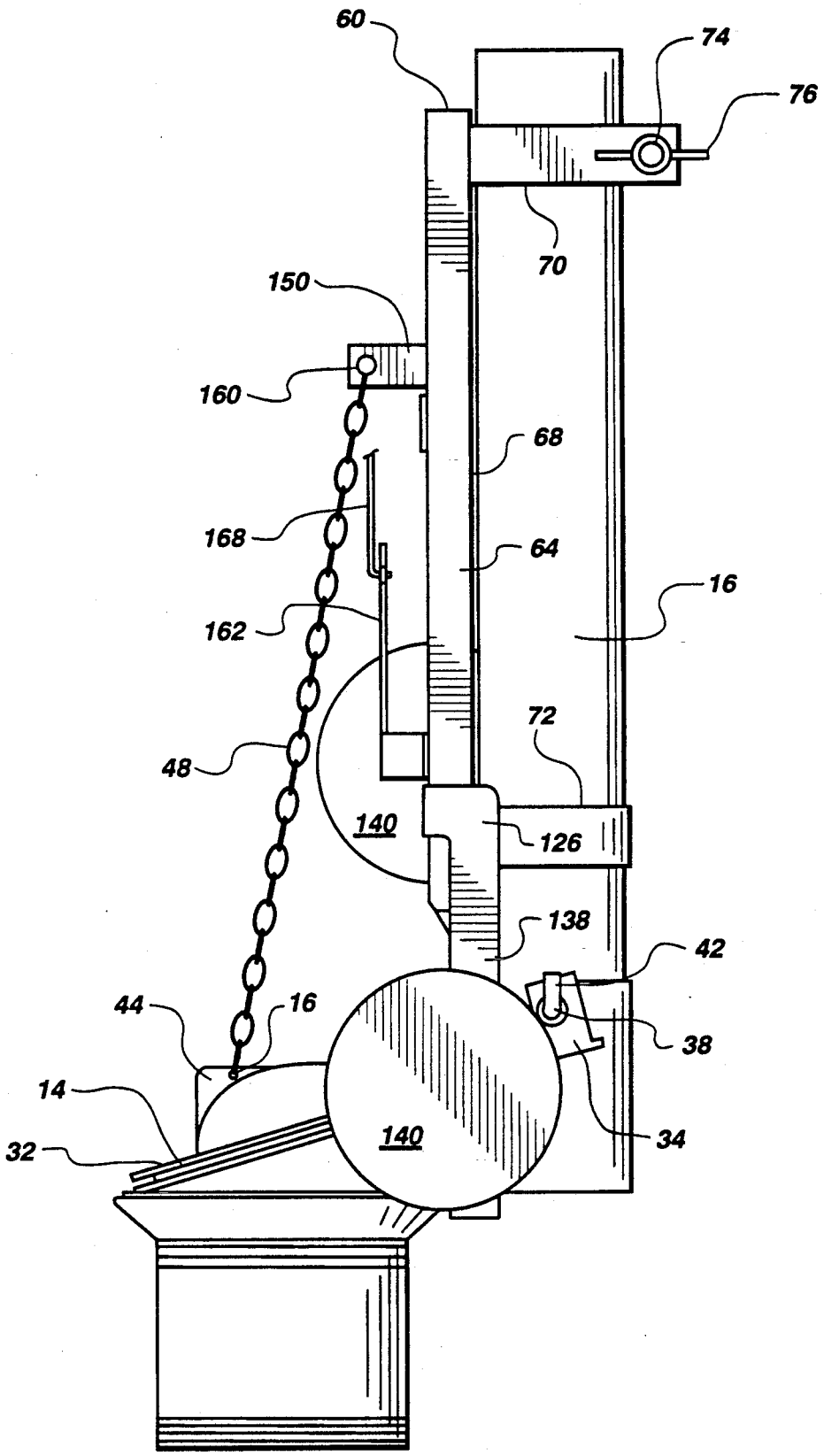
FIG. 3 is a side view of the flush valve of FIG. 1.

As shown specifically in FIGS. 1 through 5, the guide track 18 of the instant invention includes a generally planar member 60 having a plurality of upstanding planar section members mounted thereon. These section members are identified as panels 62, 64 and 66 in FIG. 1. The base member 60 as shown is a generally rectangular configured member having a pair of oppositely positioned planar faces. The plane of base member 60 is oriented generally vertically. Mounted on the back planar surface 68 of base member 60 as shown in FIG. 3 are a pair of generally circular clamp-like members 70 and 72. The circular clamps, which may be of a conventional hose clamp construction, are adapted to be positioned around the cylindrical upright draft tube 17 which is found in conventional toilet constructions. These clamps may be of the type disclosed in U.S. Pat. No. 2,452,806. Alternatively, as shown in FIG. 3, clamp 70 and 72 may be generally of plastic or synthetic material construction, and furthermore, may be molded or adhered directly to the back surface 68 of the support 60. In this particular construction, the clamps may be formed of generally circular members which are adhered to back surface 68. Each of the circular members are cut to define a pair of spacedly-positioned free ends. A bolt is inserted through a respective aperture in each free end of each circular member. A wing nut is thereafter threadedly-mounted on the bolt so as to provide the user with a means of cinching the ends and urging them against one another thereby cinching the circular member about the support tube 17.

As shown to advantage in FIGS. 1 through 5, the base member 60 includes a pair of spacedly-mounted rectangular planar members 62 and 64. Each of these members is shown to have a pair of planar sides which are positioned parallel to one another and a planar edge 74 which extends between the two upright sides. The members 62 and 64 are positioned parallel one another and extend generally along the complete length of the base member 60. The side supports 62 and 64 are oriented to extend outwardly generally orthogonal to the plane of base member 60. A central panel member, identified generally as 66 is positioned on the base member 60 between the side support 62 and 64. As shown in FIGS. 1 and 2, the central panel member 66 defines a first sidewall 76 which is generally planar in configuration and defines a surface which extends generally vertically along the complete length of the central member 66. The opposing sidewall 78 is not planar in configuration. As shown more specifically in FIG. 2, the sidewall 78 defines a section therealong, identified generally as 80, which, though planar in configuration, is not oriented parallel to the plane of sidewall 76. In fact, as indicated by the dotted lines 82 in FIG. 2, the plane of the sidewall section 80 is oriented generally at an angle 84 to the plane of the sidewall 76. The opposing sidewall to sidewall 78, i.e. the sidewall 76 extends substantially planarly along the entire height of the support guide track 24. The sidewall 78 defines a second sidewall region generally 86 which is positioned proximate the upper end of the guide track support 24. The sidewall section 86 is planar in configuration and is oriented generally parallel to the plane of sidewall 76. The sidewall support section 86 is connected to the sidewall 78 at the end of sidewall section 78. The upper end of sidewall 78 is illustrated in FIG. 2. As shown, the upper end of the sidewall section 78 defines a generally curvalinear region 88. The curved section 88 in conjunction with the sidewall section 78 and sidewall section 86, defines a recess well or notch 90 which serves as a retention means.

As shown in FIG. 2, the central section 66 in conjunction with the sidewall 62, forms a generally "U"-shaped open channel which extends vertically along substantially the entire length of the guide track 24. The channel designated generally 92, extends linearly along a longitudinal axis 94. The sidewall 62 interconnects with the central section 66 proximate the lower end of the guide track 24 by means of a stop member 96 which extends outwardly from the surface of the base member 60. The stop extension 96 forms a support for the sliding member 22 which is shown positioned within the channel 92. The stop extension 96 therefore forms an abutment surface whereby the slider 22 is precluded from any further downward displacement along the guide track 24.

In contrast to channel 92, the sidewall 64 in association with the central region 66, forms a channel 98 which has a cross-sectional configuration which varies dimensionally over the vertical height of the channel. For example, the channel 98 has a width 100 proximate the lower end 102 of the channel which is dimensionally smaller than the width 104 of the channel defined in a location 106 which is elevationally above the lower end 102 of channel 98 as shown in FIG. 2. More specifically, the width of channel 98 increases continuously from the lower end 102 of the channel over the height of the channel until one reaches the curved region 88 at which point the width of the channel begins to decrease continuously as indicated by the curved configuration of sidewall section 88 until the engagement of the region 88 with the sidewall 86. From the point of that engagement until the uppermost end 108 of the channel, the channel presents a constant width 110. Channel 98 therefore is different from channel 94 in that the sidewalls of the channel are not parallel one another. Instead, as the sliding member 20 is directed along the channel, the pathways of that sliding member may be generally non-collinear with a vertical line 111 as shown in FIG. 2.

THE SLIDING MEMBERS

As shown in FIGS. 1 and 2, the sliding members 22 and 20 may be generally rectangular cross-sectioned elongate members.

As shown, each of the sliding member 20 and 22 defines a generally rectangularly-configured end 112. The configuration of the end 112 defines the cross-sectional area of each sliding member over the entire length of the member. Each sliding member 20 and 22 defines a planar top surface 114, which when viewed from the front of the invention appears to be a planar rectangularly-configured surface. Each sliding member 20 and 22 defines a pair of upright, planarly and rectangularly-configured sidewalls 116 which are positioned spacedly apart from one another and are furthermore oriented parallel one another. Each slider member 20 and 22 furthermore defines a bottom surface which is not shown, but nevertheless, is of a planar construction and is rectangular in configuration. The bottom surface 118 corresponds generally and is identical to the top surface 114. The plane of bottom surface 118 is oriented parallel to the plane of top surface 114. Each of the slider members 20 and 22 is dimensioned so as to be slideably received within its respective channel 92 and 98 as shown specifically in FIG. 2. Each of the widths of the sliding members is substantially less than the width of the channel member whereby the slider member has some degree of lateral movement capability.

As shown in FIG. 2, each of the slider members 20 and 22 may have its lower end 120 configured to define a generally semi-circularly-configured end. The ends 120 of the sliding members may be dimensioned and configured to correspond generally to the outer upwardly-directed surface of a respective stop member 96 whereby each sliding member 20 and 22 may rest and abut against that its respective stop member 96 in the valve's rest, closed condition thereby forming a cradle for the free lower end of each slider member. The slider members 20 and 22 are retained within their respective channels 92 and 98 by a retaining strip 122 which is shown in FIGS. 1 and 2 as being mounted on the top surface of the central section 66 by means of a screw 124. The retaining strip 122 is a generally elongate panel which extends between the central section 66 to a position over and atop both the sidewall 62 and 64 thereby forming a ceiling or roof over a section of each of the channels 92 and 98. The retaining strip 122 serves as a means for retaining each of the slider strips 20 and 22 in their respective channels.

THE BUOYANT MEMBERS

As shown in FIGS. 1 through 5, each slider strip 20 and 22 is fitted with a respective buoyant member 26 and 28.

As shown more specifically in FIGS. 1 and 2, each of these buoyant members is formed by three structural members. A laterally-extending support 126 is mounted to a respective slider strip 20 or 24 to extend laterally and outwardly therefrom generally orthogonal to the longitudinal axis of its respective slider member 20 or 22. The extension bracket 126 may be adhered, i.e., glued to the slider member 20 or 22 or alternatively as shown in FIG. 1, the extension brackets 126 may be secured to their respective members by means of screws 134. Alternatively, the extension bracket 126 and a respective slider member (20 or 22) may be molded as a single integral unit. Each extension bracket 126 is formed in a generally inverted "L"-shaped configuration.

As shown more particularly in FIG. 2, each extension member 126 may be viewed to be formed by a generally horizontally-extending leg 136 which is interconnected to a generally vertically-extending section 138. Mounted on each extension 138 is a hollow, float 140 which has a air-filled interior. The float interior is sealed to be liquid-tight. Mounted on a outward sidewall surface 142 of each buoyant member 140 is a generally "U"-shaped bracket 144 which defines a channel 146 therethrough which is dimensioned to snugly receive the section 138 of bracket extension 126. The intercooperation of bracket 144 with the section 138 provides a means whereby the user may adjust the positioning of the float 140 on the bracket 126 by sliding the bracket upwardly or downwardly along the length of section 138. The channel 146 is dimensioned to sufficiently snugly receive the section 138 that upon its being positioned in a selected location, the magnitude of the forces being applied to the bracket subsequently by the immersion of the float in the water of the storage reservoir is not sufficient to overcome the frictional drag of the bracket along the section 138. In preferred constructions, the extension bracket 126 and the bracket 146 are formed of plastic or other synthetic material which is both resistant to corrosion by the water of the tank and furthermore, is suitable for easy fabrication and manufacturing processes. As shown in FIG. 1, bracket 144 may be secured to float 140 by a screw which provides a means of biasing the bracket against bracket section 138.

THE CONNECTION BRACKETS

Each of the sliding members 20 and 22 is interconnected to the flapper valve 14 by means of a respective chain 48 and 50.

As shown to advantage in FIG. 1, the chains 48 and 50 are mounted to mounting extension 44 on their first end by means of the circular ring 46 on the mounting bracket 44. The opposing ends of each of the chains 48 and 50 are individually secured to a respective "L"-shaped bracket generally 150 which is mounted to a respective sliding member 20 or 22.

As shown more specifically in FIG. 1, each "L"-shaped bracket 150 is secured to its respective slider member by a screw 152 which extends through an aperture in the mounting bracket 150 and thereafter into the body of the respective slider 20 or 22. The outwardly-extending leg 154 of each extension, defines an aperture therethrough 160 which is configured to receive the free end of a respective chain 46 or 50 and form a connection therewith. It should be recognized that while the preferred embodiment shown in FIG. 1 includes the use of a metallic chain 48 or 50, that any flexible member of sufficient integrity to transmit forces from the slider member 20 or 22 to the valve 14 may be substituted for the metal chains 48 and 50.

As shown further in FIGS. 1 and 2, a generally "L"-shaped auxiliary mounting bracket 162 is mounted to slider member 20 proximate the mounting of the extension bracket 126 on that slider member. In the particular embodiment illustrated, the "L"-shaped extension bracket 162 is joined to the slider 20 by means of the screw 134 which also joins the extension bracket 126 to slider member 20. The extension bracket 162 is shown in FIG. 2 as being joined to the sliding member 20 by means of a separate screw 164. It should be understood that the two mounting constructions shown for the extension bracket 162 are both usable in the instant invention. One leg of the extension 162 defines an aperture 166 dimensioned to receive a linkage member 168. In FIG. 1, this linkage member 168 is shown as a flexible, elastomeric strip. An alternative construction shown in FIG. 2, illustrates this member 168 as being a metal chain.

THE LEVER ACTUATION MEANS

The valve of the instant invention is controlled by the action of an actuation means which is illustrated as a control lever assembly. Various control lever assemblies are presently contemplated for use with the valve of the invention. A first lever assembly is shown to advantage in FIGS. 4 and 5. As shown, a elongate lever shaft 170 in which is mounted to a hand-graspable handle which is rotatably secured within the sidewall of the toilet tank reservoir (not shown) lever shaft 170 defines a plurality of apertures 172 which are spacedly positioned along the length of the lever shaft 170. A first aperture **172*a* is interconnected to a coil spring 174 on the first end of the spring. The opposing end of the spring 174 is secured to the "L"-shaped mounting bracket 150 which is, in turn, mounted on sliding member 22**.

Figure 4:
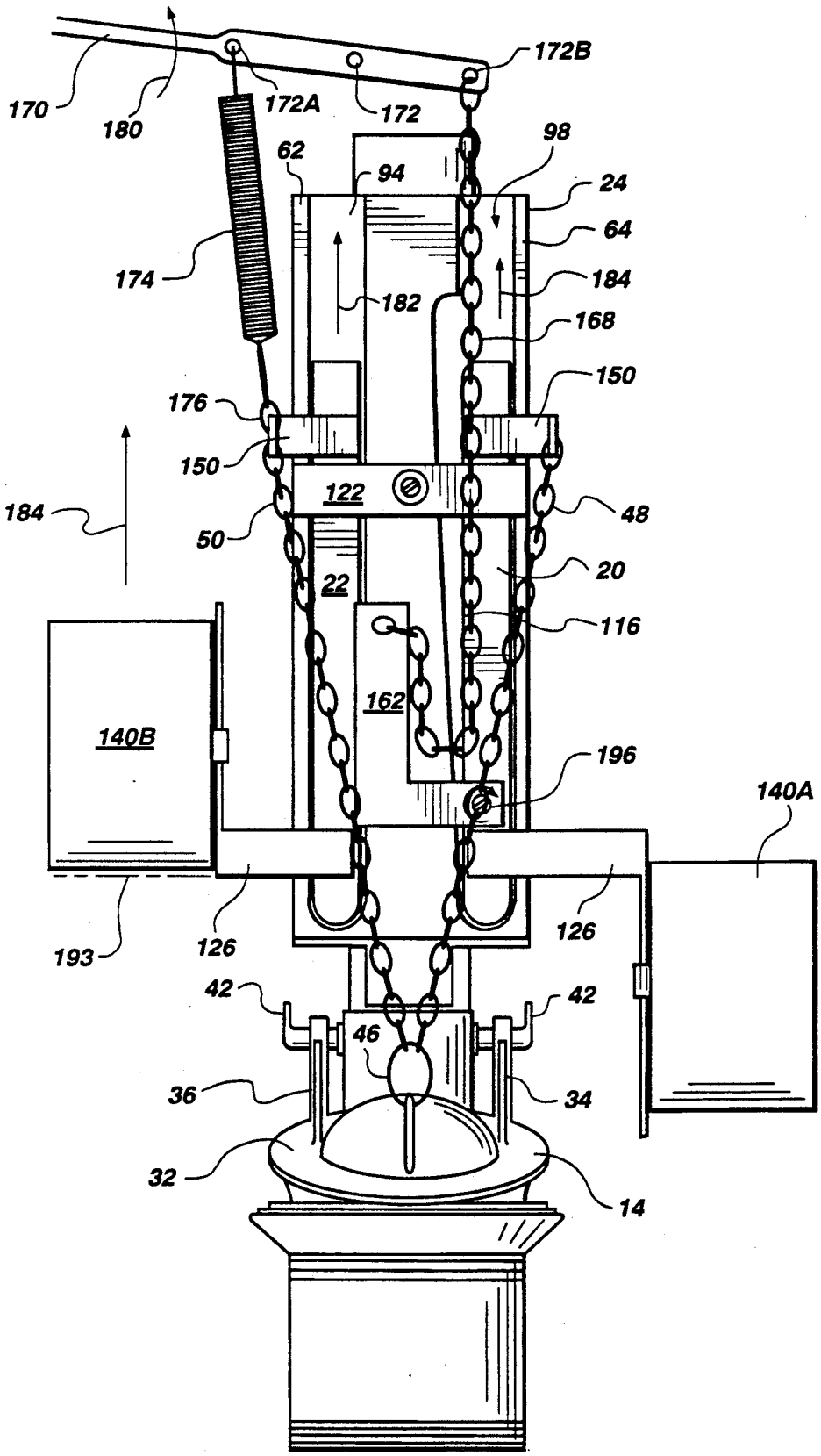
FIG. 4 is a front view of the flush valve of the invention in association with a lever-type actuation member.

As shown in FIG. 4, the spring 174 is mounted to the extension 150 by means of a circular ring 176. A second aperture 172 in lever shaft 170 is interconnected with the "L"-shape mounting bracket 162 by means of the linkage member 168 which is shown as being a metallic chain. As shown to advantage in FIG. 4, in a closed condition, each of the mounting brackets 150 rest atop the retaining strip 122. In this orientation, the respective chains 50 and 48 are shown to extend in a generally taut condition between their respective mounting brackets 150 and the mounting bracket 44 of the flapper valve 14. In this orientation, the chains 50 and 48 form a generally "V"-shaped configuration. In contrast, the linkage member 168 is shown as being sufficiently dimensioned in length so as to be in a slack condition in its connection to shaft member 170 and the "L"-shaped bracket extension 162. Given a upward displacement of the member 170 in the direction indicated generally by arrow 180, the spring 174 is initially tensioned and thereafter urges that slider member in the direction indicated by arrow 182. Given this displacement, the chain 50 transmits an upwardly-directed force to the mounting bracket 44 of sufficient magnitude to displace the valve 14 from its seat 56 into the orientation shown generally in FIG. 5. During this displacement, the float member **140*b* is likewise directed upward vertically in the direction indicated by arrow 182. The valve 14's engagement against its seat 56, due to the weight of the water atop the valve and any vacuum forces which may exist within the discharge outlet 58, have previously held the flapper valve 14 in position. The tautness of chain 48 has held the slider member 20. With an upward displacement of flapper valve 14, the slider 20 is now free to react to the buoyant forces being applied thereto by the action of the float 140*a* with an upward displacement in the direction of the arrow 182. As the flapper valve 14 is displaced upwardly, slider 20 is driven upwardly through channel 98 by the buoyancy-created forces engendered by float 140***a*. Due to the configuration of the channel 98, the sidewall 116 of slider member 20, rides along the surface of sidewall section 80 of the central section 66. This displacement is most likely caused by a moment being created on the slider section 20 by the action of the float 140*a* in conjunction with its mounting to the slider 20 by means of the extension bracket 126. This moment is illustrated schematically by the arrow 190 as shown in FIG. 2. As the slider 20 is displaced upward within channel 98 along the surface of sidewall section 80, eventually the top surface of the slider 20 is directed into engagement against the recess well in notch 90 defined by sidewall 88. As shown more specifically in FIG. 5, the topmost surface of slider 20 is configured to have a curved region which is configured to correspond to the sidewall section 88 whereby the sidewall 88 forms a cradle for the upper end of slider 20. As the slider 20 engages or is inserted into the recess well 90 defined by side section 88, the upward displacement of the slider 20 is precluded and the slider 20 is generally held in position in the recess well 90 by the buoyant-force-induced moment 190.

In this condition, the valve is held out of engagement against the seat 56 and the water in the storage tank of the toilet wherein the flush reservoir has been mounted is free to exit the storage valve through outlet 58 into the toilet bowl of the toilet. As the surface level of the water within the storage reservoir drops within the reservoir, the user releases the lever shaft 170. The displacement of slider 22 is now in large part determined by the forces being applied thereto by the float 140*b*. The float 140*b*, due to its buoyant nature, generally floats on or substantially near the surface of the water within the storage reservoir. As the surface level of that water drops within the tank, the float 140*b* likewise is displaced downwardly. As the float 140*b* is displaced downwardly, the tautness of the chain 50 begins to lessen. As the water enters the interior of the member 50 through the apertures 52 and 54 displacing the air contained therein and increasing the weight of the float valve 14, the water causes the float valve 14 to be urged downwardly as the surface level in the tank drops. Upon the water level in the tank falling below the level indicated by line 193 in FIG. 4, the further downward displacement of the float 140*b* is precluded due to the action of the lower end of the slider 22 against the stop member 96. At this point, the length and positioning of the chain 50 are such to permit the flapper valve 14 to reengage its seat 56 and thereby close the outlet 58. Throughout this operation, the float valve 140*a* and the slider 20 have little, if any, affect on the action of the flapper valve 14.

The above description is illustrative of what is termed as the "first flush condition" wherein a first quantity of water from the storage reservoir has been discharged from the storage reservoir into the toilet bowl.

In preferred constructions, the float 140*b* in association with it respective slider 22, are adjusted to permit a relatively small volume of water to be discharged from the storage reservoir of the toilet. This first flush condition is specifically directed for use in evacuating the toilet bowl of liquid waste materials.

A second flush condition which is specifically adapted for discharging a larger quantity of water from the storage reservoir of the toilet by means of the float valve 140*a* and its respective slider 20, will now be discussed.

Referring to FIG. 4, the lever member 170 may be further rotated in the direction 180 by the user, i.e., the lever may be rotated further than previously described in actuating the displacement of slider 22. Given such a further rotation of the lever member 170 sufficient to cause the linkage 168 to be drawn taut against the bracket extension 162 and furthermore, to apply a sufficient additional force to that extension to thereby cause a countermoment about the connection point of that extension 162 on the slider 20 sufficient to overcome the moment induced on the slider by the action of the float 140*a*. This countermoment illustrated by arrow 196 in FIG. 4, causes the slider 20 to be disengaged out of its retained position shown in FIG. 5 in the recess well 90 defined by sidewall section 88. As the slider 20 is disengaged from the recess well 90, the upwardly-directed forces being applied to the slider 20 by buoyancy induced forces of float 140*a*, cause the slider 20 to be displaced upwardly. It should be recognized throughout this discussion that the previously-described action of slider 22 also occurs during the obtention of this second flush condition.

During the initiation of the second flush condition, all of the procedural and process steps which have been heretofore described in obtaining the first-flush condition have previously occurred. The principal difference which separates the two flush conditions is the fact that as the slider 22 is urged upwardly thereby disengaging the flapper valve 14, a further displacement or rotation of the actuation lever 170 in the direction indicated by arrow 180 causes the above described further disengagement and displacement of the slider 20.

Figure 6:
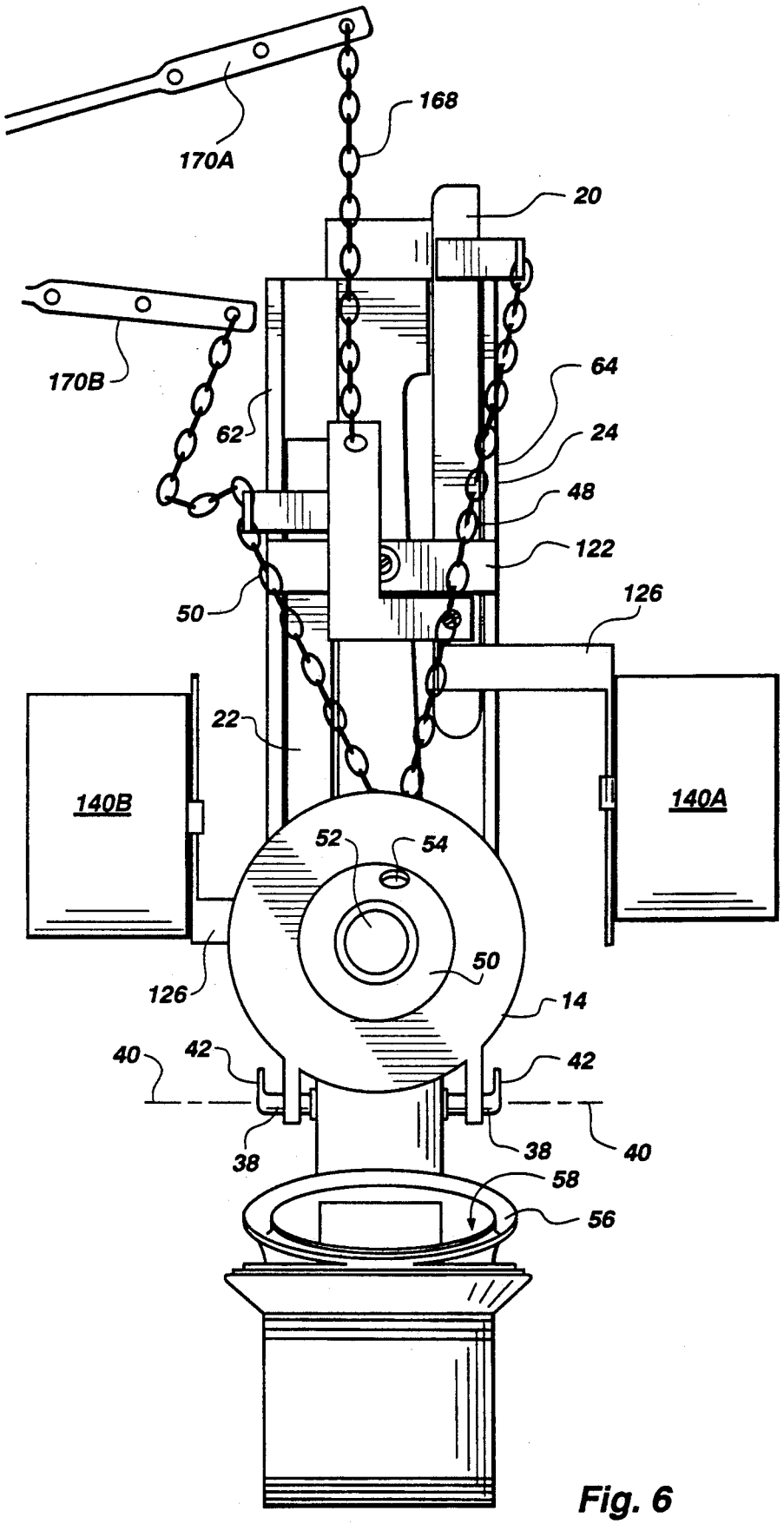
FIG. 6 is a front view of the flush valve of the invention wherein the flush valve is shown in a second-open condition.

As the slider 20 is urged upwardly by the buoyancy-induced action of the float 140*a*, the upward progress of that slider eventually is precluded as the bracket extension 162 comes into abutment against the retainer strip 122 as shown to advantage in FIG. 6. It follows that as the surface level of the water in the storage reservoir drops as the water is discharged through the outlet opening 58, eventually both of the floats 140*b* and 140*a* begin to be displaced downwardly as they ride atop the surface level of the water in the reservoir. However, in contrast with the previously-described interaction of the float valve 140*b* and its respective slider 22 in conjunction with the chain 50 and the flapper valve 14, as the float 140*b* drops in elevation and the chain 50 becomes slack, the flapper valve 14 is not permitted to immediately reengage its seat 56. This is due to the fact that the chain 48, which is mounted to slider strip 20, has been retained in a taut condition by the slider 20 and its float valve 140*a*. As shown to advantage in FIG. 6, while both of the float valves 140*b* and 140*a* may be substantially at the same elevation within the tank, the elevation of the point of connection of the two chains 50 and 48 to their respective slider strips is disparate, i.e., the connection of the chain 48 to slider strip 20 is elevationally above the connection of the chain 50 to slider strip 22. It follows that as the floats 140*a* and 140*b* are displaced downwardly in the tank due to the falling level of the water, at one point the chain 50 has no further operative effect on the displacement of the flapper 14. Instead, the action or displaceability or the rotation of that flapper valve 14 is controlled by chain 48. As the float 140*a* continues to drop in the tank, eventually the chain 48 becomes slack or otherwise is positioned to permit the valve 14 to reengage its seat 56 in the orientation shown generally in FIG. 2. At this point, the valve is reoriented, as shown in FIG. 2, in its closed condition thereby awaiting another displacement of the actuation lever 170 to again initiate the flush cycle. It should be recognized that the volume of the water being discharged from the storage reservoir in a second flush condition is significantly larger than that which is discharged from the tank in the first flush condition.

It should be pointed out that the lever that the connection between the actuation levers 170 and the slider strips 20 and 22 as shown in FIGS. 4, 5 and 6, are different from one another. More specifically, the drawings illustrate three separate means of interconnecting the actuation lever with the respective sliders 20 and 22. For example, in FIG. 4, the lever shaft 170 is shown connected directly to the bracket extension 150. In contrast, in FIG. 5, the spring 174 is shown connected to the bracket extension 126. Understandably, in both of these particular embodiments, the spring 174 is dimensioned to accommodate the actions described hereinabove. This dimensionally facilitates the relocation of that spring's mounting from one extension bracket to the other. FIG. 6 discloses the use of a pair of actuation levers 170*a* and 170*b*. In this particular construction, an actuation lever which may have the configuration of the lever assembly shown in FIGS. 10 through 12 may be used.

Figure 10:
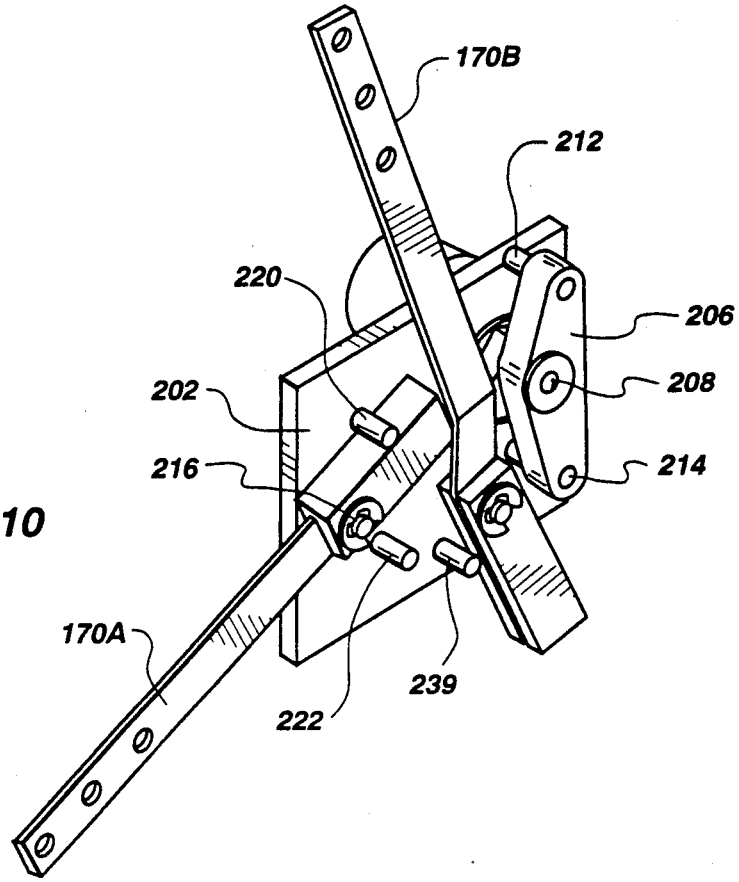
FIG. 10 is a perspective view of a lever actuation means, adapted for use with the flush valve of the invention, shown in a first orientation.
Figure 11:
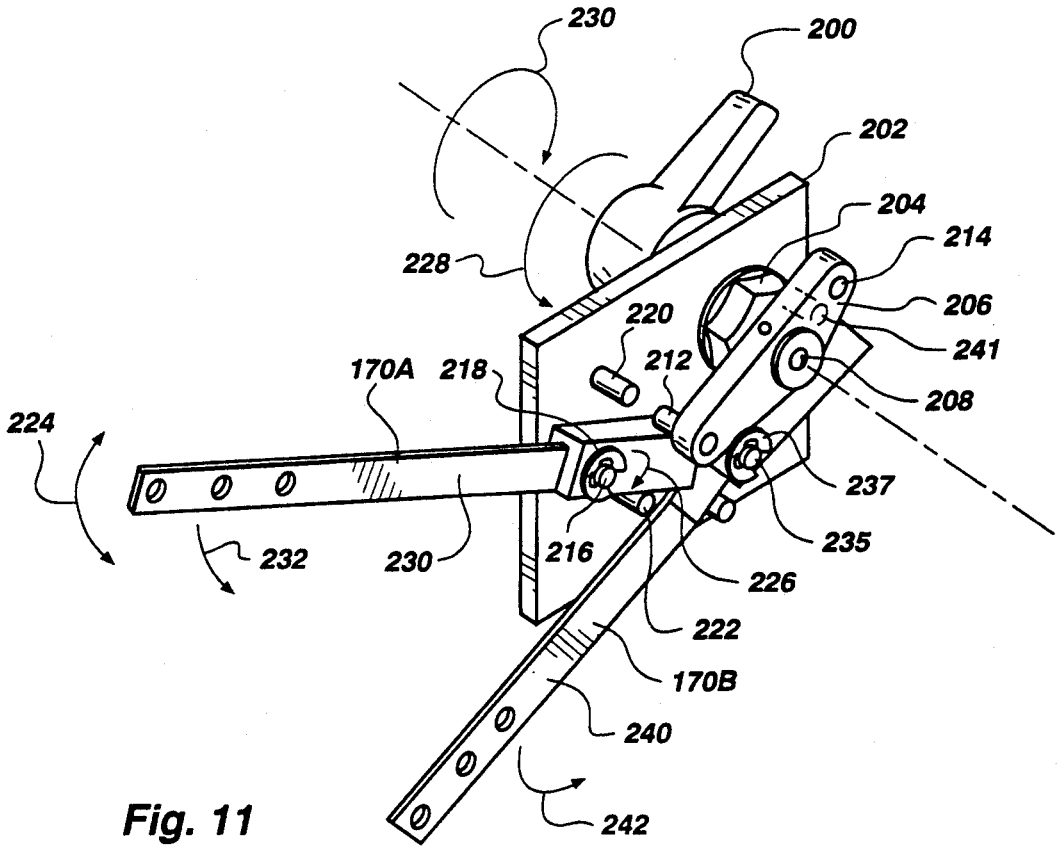
FIG. 11 is a perspective view of the lever actuation member shown in FIG. 10 illustrated in a second orientation.
Figure 12:
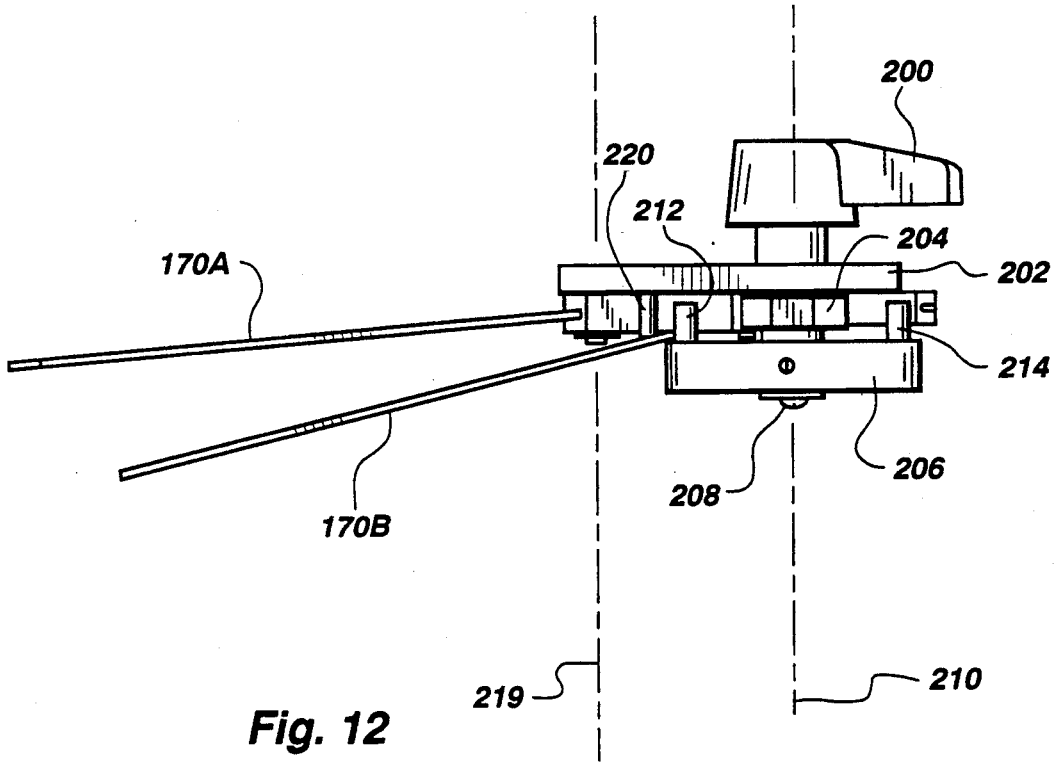
FIG. 12 is a top view of lever actuation member as shown in FIG. 10.

As shown in FIG. 10, the lever assembly may include a hand-graspable lever 200 which is journaled through the wall of the toilet reservoir 202 and is held in place by a lock nut 204. The lever 200 includes a laterally-extending shaft which extends through the sidewall 202 of the storage reservoir and includes thereon a plurality of male threads which interact with the female threads of the lock nut 204. The shaft, which is not shown, is connected to a driver 206 by means of a screw and washer arrangement 208. The driver 206 is fixedly mounted to the shaft whereby any displacement of the lever 200 effects a corresponding displacement, i.e., rotation of the driver 206 about the horizontal axis 210 shown in FIG. 12. Mounted on the driver 206 are a pair of spacedly-mounted drive pegs 212 and 214. Each of these drive pegs extend outwardly generally orthogonally from the surface of the driver 206. The drive pegs 212 and 214 are spacedly positioned apart from one another and are each positioned proximate the free end of the driver 206. Actuating lever 170*a* is rotatably mounted to the sidewall 202 of the storage reservoir by means of an elongate cylindrical axle 216. The lever actuation shaft 178 is retained in position on the axle 216 by a lock washer 218. The actuating lever 170*a* is therefore adapted for rotation about a horizontal axis 219 as shown in FIG. 12. Positioned proximate the actuating lever 170*a* are a pair of spacedly-mounting retaining pins 220 and 222 which are mounted on the sidewall 202 to extend outwardly therefrom. The pins 220 and 222 extends generally parallel one another and are positioned sufficiently spacedly apart to receive the lever actuation member 170*a* therebetween and form a means of restricting the rotational displacement of that actuating lever 170*a* in the directions indicated by the arrow 224. As shown, the driving peg 212 is positioned to engage against the actuating lever 170*a* and thereby depress that member downward causing a displacement indicated by arrow 226. This occurs upon a rotation of the driver 206 in the direction indicated by arrow 228. With the rotation of the driver 206 in the direction indicated by 230, the peg 212 is directed upward and out of engagement against the actuating member 170*a*. When this occurs, the weight of the lever arm 230, which is positioned outwardly from its mounting 216, causes the lever arm 170*a* to be displaced in the direction indicated by arrow 232, as shown to advantage in FIG. 10. The actuating lever 170*b* is also mounted to the sidewall 202 of the storage reservoir by means of an axle 235 which is mounted to the sidewall 202 and is journaled through the lever arm 170*b* and is retained in position vis-a-vis that lever arm by means of a lock washer 237. The lever 170*b* is positioned between two retaining pins 239 and 241.

Similar to the operation of actuation member 170*a*, 170*b* is urged in an upward direction as shown in FIG. 10 by the action of the drive pin 214. This upward displacement is caused by the rotation of the driver 206 in the direction indicated by arrow 230. With a reversal of the rotational direction, i.e., in the direction indicated by arrow 228, the engagement of the driver pin 214 on the actuation lever 170*b* is released thereby permitting the weight of the section 240 of the lever arm to cause a rotation of the lever arm 170*b* about its rotational axle 235 in the direction indicated by arrow 242.

Returning to FIG. 6, it is seen that the two actuation levers 170*a* and 170*b* are each individually connected to a respective extension bracket. As shown, actuation lever 170*b* is interconnected to the extension bracket 150 mounted on slide 22. The actuation lever 170*a* is interconnected to the extension bracket 162 by a chain 250. In the two-lever arrangement shown in FIG. 6, the operation of lever 170*b* essentially corresponds to the operation of lever 170 in FIG. 4 as to the operation of that lever in actuating the first flush condition by means of the spring 174. The operation of actuation lever 170*a* corresponds substantially to the operation of lever 170 in FIG. 4 as pertains to the use of the employment of the connection chain 168 to achieve a second-flush condition. The difference between the operation of the two-lever actuation structure and the operation of the one-lever actuation member shown in FIG. 4, is that in the operation of the single lever member, shown in FIG. 4 both of the slider members 20 and 22 are positively acted upon directly by an actuation lever in order to obtain a second condition flush cycle. In the arrangement shown in FIG. 6, each of the sliders is forcibly displaced by a respective lever member, i.e., lever 170*a* operates to displace only the slider 20 whereas operation of the lever 170*b* operates only to positively displace the slider 22.

ALTERNATIVE EMBODIMENT

Figure 7:
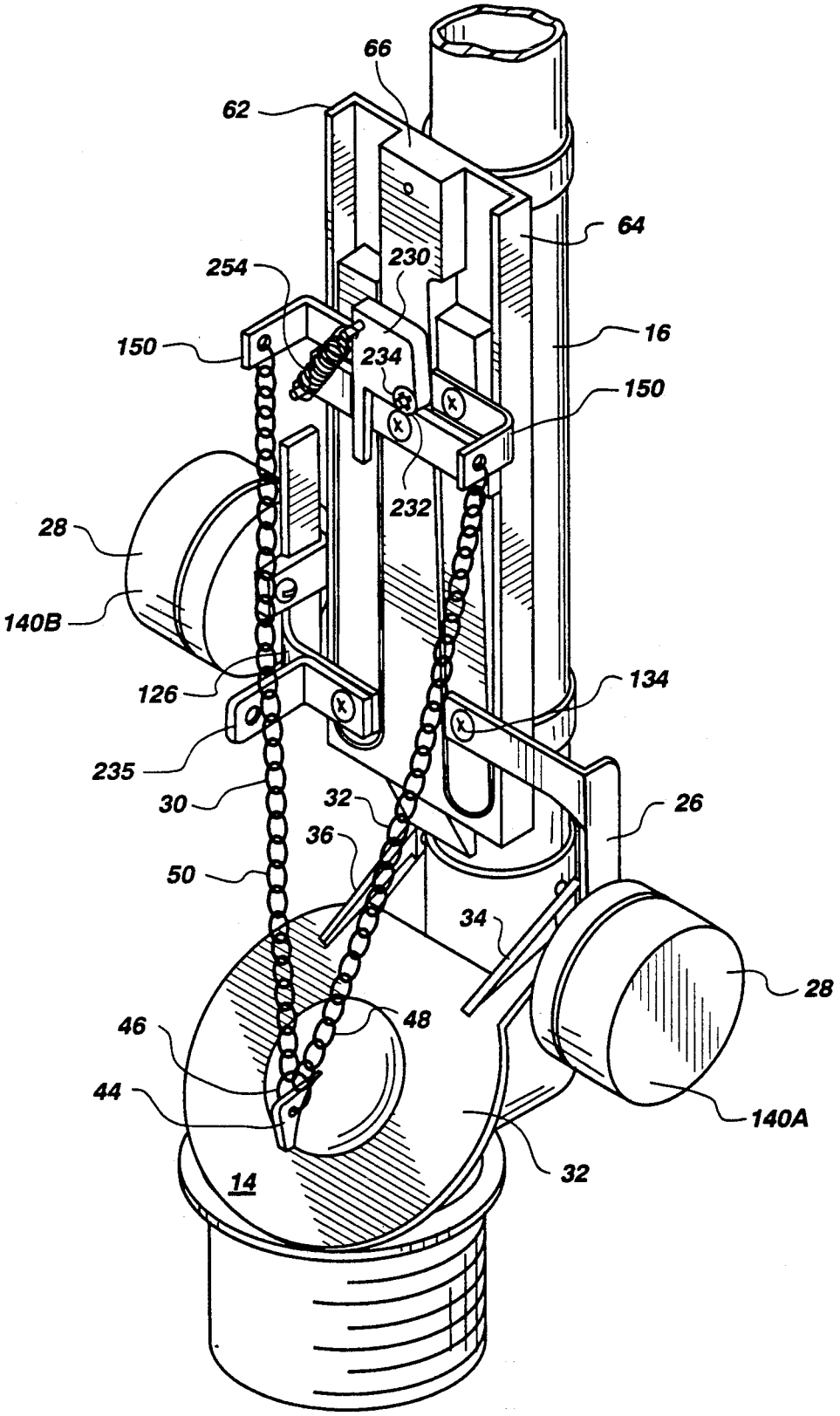
FIG. 7 is a perspective view of a alternative embodiment of the invention.
Figure 8:
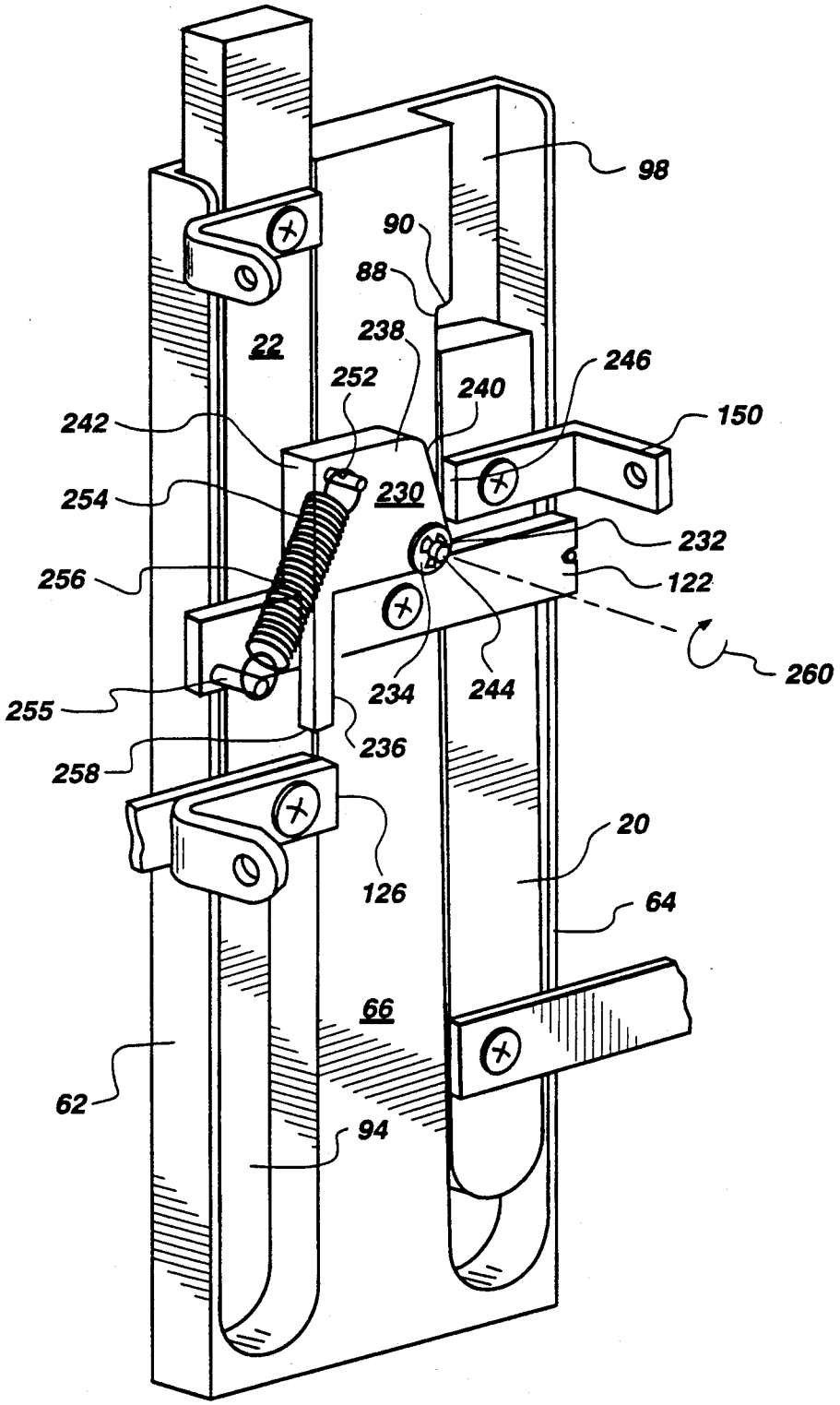
FIG. 8 is a partial sectional view of the guide track of the valve as shown in FIG. 7.
Figure 9:
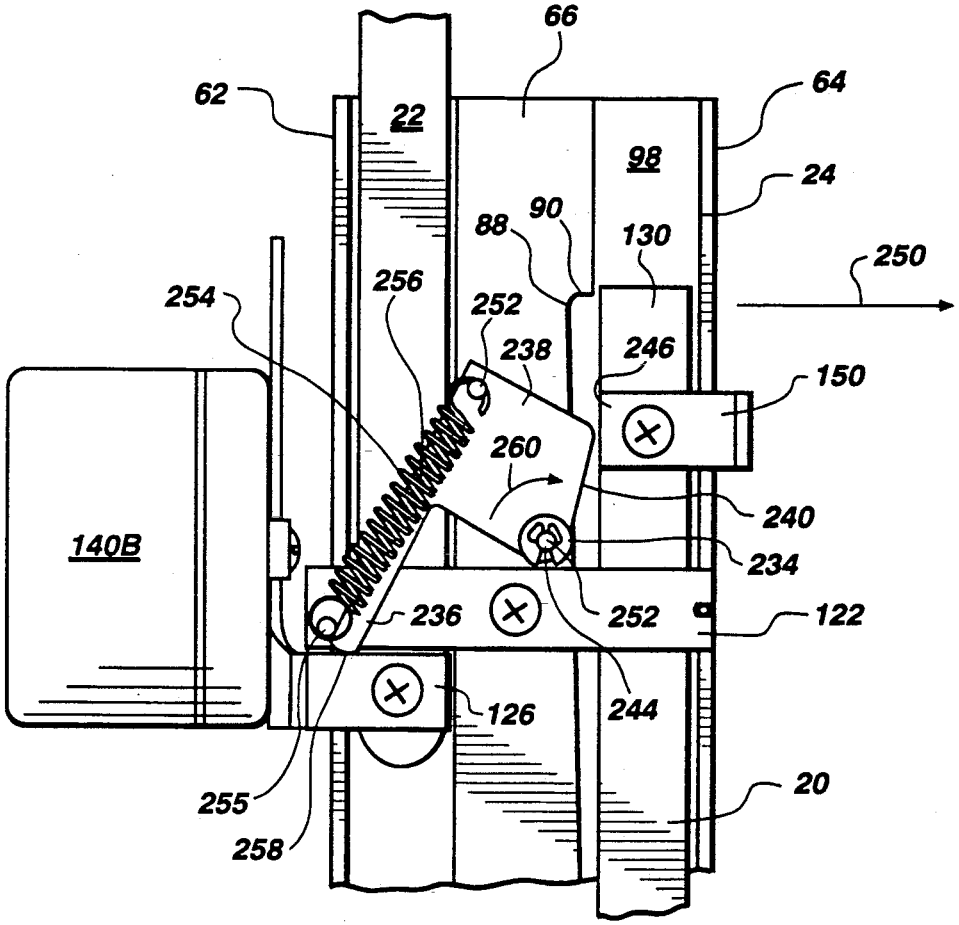
FIG. 9 is a frontal sectional view of the guide track as shown in FIG. 8.

FIGS. 7 through 9 illustrate an alternative embodiment of the instant invention. In this particular construction, the function of the mounting bracket 162 has been replaced by the use of a cam-type structure which is rotatably mounted on the central panel section 66 of the guide track 24. As shown specifically in FIG. 7, a cam 230 is rotatably mounted to the section 66 by means of cylindrical axle 232 which extends outwardly from the central panel section 66. The cam 230 is held in place on the axle 232 by means of a a retaining ring 234 e.g. a retaining "E"-ring. As shown in detail in FIG. 9, the cam 230 includes an elongate leg 236 which extends from a generally flat-surfaced section 238. Section 238 defines a camming surface 240 which is shown as being generally a flat-surfaced sidewall of the section 238 which is oriented at an angle to a vertically-upright sidewall 242 of the opposing sidewall 242 of the section 238. The surface 240 is adapted to be rotated about the axis 244 to engage against the vertical sidewall 246 of mounting extension 150. Given a sufficient force application by the cam 230 against that sidewall surface 246, the slider 20 is urged outwardly in the direction indicated by arrow 250 sufficiently such that the end 130 of slider 20 is disengaged from the notch 90 formed by sidewall section 88 of center section 66. The leg 236 extends downwardly and is positioned so as to engage a mounting bracket 126 upon that mounting bracket being urged upwardly a selected distance. As shown bracket 126 defines an aperture therein configured to anchor a spring or other linkage member which is connected to an actuation lever 170 of the type illustrated as actuation member 170 in FIG. 4. A pin 252 extends outwardly from the surface of section 238 of cam 230. A spring 254 is mounted on a pin 252. A second pin 255 is mounted on the retaining strip 122 to extend outwardly therefrom. Pin 255 intercooperates with the second end of the spring 254. The spring 254 is tensioned in the orientation shown in FIG. 8 thereby applying a force to the cam 230 to retain it in the position shown. The cam 230 furthermore is oriented to rest atop the retaining strip 122 by means of a lip 256 which is shown to advantage in FIG. 8. The cam 230 obtains a rest position in the orientation shown in FIG. 8. Upon an upward displacement of the slider 22 sufficient that the mounting bracket 126 engages the bottom end 258 of leg 236 the cam 230 rotates about its axle 244, in the direction shown by 260. The spring 254 operates to create an opposing moment on cam 230 about the axle 244 in opposition to the rotation induced by mounting bracket 126 as the slider 22 continues to rise through its channel 94. A camming surface 240 of cam 230 engages the surface 246 of extension 150 thereby urging the slider 20 in the direction indicated by arrow 250 sufficient that slider 20 disengages from the notch 90 defined by section 88 of central section 66. Upon the slider 20 being disengaged from its notch 90, the slider 20 is free to continue its upward ascent through channel 98 thereby permitting the operation of the valve as previously disclosed. Upon the slider 22 beginning its descent downward through channel 94 when the surface level of the water within the reservoir descends and when the mounting bracket 126 has descended a sufficient distance that it no longer engages against leg 236, the spring 254 returns the cam 230 to the rest condition as shown in FIG. 8. The remaining operation of the valve is as previously disclosed in the first described embodiment.

The alternative embodiment as shown in FIGS. 7 through 9 permits the operation of the valve by use of a single actuating lever similar to the construction shown in FIG. 4 with the exception that the need for the auxiliary chain 168 has been eliminated, it follows that the actuating lever 170 is directly connectable to the extension 150 on slider 22 and this connection would constitute the sole connection of the actuating lever 170 with the valve assembly itself.

While the invention has been described in detail above, it is to be understood that this detailed description is by way of example only, and the protection granted is to be limited only within the spirit of the invention in the scope of the following claims.

What is claimed is:

1. A flush valve assembly for use in the water storage reservoir of a toilet having a water outlet and a valve for opening and closing said water outlet, said flush valve assembly comprising:

two displaceable slide members, each said slide member in use being connected to said valve;

a vertically disposed guide defining two elongate channels, each said slide member being slideably mounted in a respective said channel;

two buoyant floats, each said float being connected to a respective said slide member; actuation means connected with said slide members for individually displacing said slide members along said guide means;

wherein a first said channel includes a retention means for releaseably retaining an upward displacement along said channel of a said slide member mounted within said first channel; and wherein a displacement of a first said slide member effects an opening of said valve means resulting in a discharge of a first quantity of water from said water storage reservoir and a displacement of a second said sliding member effecting an opening of said valve means resulting in a discharge of a second quantity of water from said water storage reservoir, said first quantity of water being smaller than said second quantity of water.

2. The flush valve of claim 1 wherein said buoyant float is mounted to be elevationally higher than said buoyant float mounted on said second sliding member when said valve means is in a closed orientation.

3. The flush valve of claim 1 wherein at least one of said buoyant floats is mounted on its said respective slider member to be vertically adjustable thereon.

4. The flush valve of claim 1 wherein said valve means is connected to said slide members by means of a plurality of flexible members.

5. The flush valve of claim 4 wherein said flexible members are chains.

6. The flush valve of claim 1 wherein said retention means comprises a recess well configured to receive and releaseably retain a portion of said second slide member.

7. The flush valve of claim 6 wherein said retention means fitted channel includes two upstanding sidewalls which are oriented non-parallel to one another, one of said sidewalls being configured to direct said respective slide member into said recess well.

8. The flush valve of claim 6 wherein said flush valve further includes a disengagement means mounted on said guide means for disengaging said second slide member from its retention by said retention means.

9. The flush valve of claim 8 wherein said disengagement means is a bracket mounted on said second slide member, said bracket being connected to said actuation means.

10. The flush valve of claim 8 wherein said disengagement means is a cam rotatably mounted on said guide means adapted for engaging said respective slide member upon said cam being engaged by a displacement of said second slide member.

* * * * *